US007359175B2

(12) United States Patent
Morita

(10) Patent No.: US 7,359,175 B2
(45) Date of Patent: Apr. 15, 2008

(54) RELAY DRIVE CIRCUIT

(75) Inventor: Manabu Morita, Anjo (JP)

(73) Assignee: Anden Co., Ltd., Anjo (JP)

( * ) Notice: Subject to any disclaimer, the term of this patent is extended or adjusted under 35 U.S.C. 154(b) by 0 days.

(21) Appl. No.: 11/638,365

(22) Filed: Dec. 14, 2006

(65) Prior Publication Data

US 2007/0146959 A1 Jun. 28, 2007

(30) Foreign Application Priority Data

Dec. 28, 2005 (JP) ..... 2005-378166
Sep. 26, 2006 (JP) ..... 2006-260573

(51) Int. Cl.
*H01H 47/02* (2006.01)
*H01H 47/04* (2006.01)

(52) U.S. Cl. ..... 361/160; 361/154; 361/153; 361/152

(58) Field of Classification Search ..... 361/160, 361/154, 152, 153
See application file for complete search history.

(56) References Cited

U.S. PATENT DOCUMENTS 2,955,240 A * 10/1960 Gardner ..... 335/273
4,368,501 A * 1/1983 Gingrich ..... 361/152
5,196,730 A * 3/1993 Matsuo ..... 317/132 EA
5,317,475 A 5/1994 Siepmann
5,428,496 A * 6/1995 Buchta ..... 361/152
6,249,418 B1 * 6/2001 Bergstrom ..... 361/152
6,807,036 B2 * 10/2004 Baldwin ..... 361/42
2005/0024102 A1 2/2005 Kondo

FOREIGN PATENT DOCUMENTS

JP 408077903 * 3/1996

* cited by examiner

*Primary Examiner*—Michael Sherry
*Assistant Examiner*—Zeev Kitov
(74) *Attorney, Agent, or Firm*—Posz Law Group, PLC

(57) ABSTRACT

A potential of an end of the coil is inputted to a plate-OFF detecting portion which detects OFF-tendency in which a plate of a relay is about to get apart from a head of a core of the relay. When the OFF-tendency is detected, a coil current for supplying a coil of the relay is set to a first current value with which a plate of an electromagnetic relay is drawn and a movable contact of the relay comes in contact with a fixed contact of the relay. When an external disturbance ends, the coil current is returned to a second current value, which is smaller than the first current value, so that the movable contact and the fixed contact are kept in contact with each other.

14 Claims, 11 Drawing Sheets

RELAY DRIVE CIRCUIT

CROSS REFERENCE TO RELATED APPLICATION

This application is based on and incorporates herein by reference Japanese patent applications No. 2005-378166 filed on Dec. 28, 2005 and No. 2006-260573 filed on Sep. 26, 2006.

FIELD OF THE INVENTION

The present invention relates to a relay drive circuit for controlling ON and OFF states of an electromagnetic relay provided in a line for supplying electric power of a power source.

BACKGROUND OF THE INVENTION

In an electromagnetic relay, a sudden external disturbance such as an external shock sometimes causes an electrical connection in the relay to become off. For example, an external disturbance detaches a plate (, or an armature) from a coil of the relay and accordingly turns the relay to OFF.

In JP 2005-50733A, an art is proposed which regains the ON state of the relay by supplying electric power to the coil on detecting that the relay is turned to OFF.

However, since the conventional art regains the ON state after the relay gets to the OFF state, the conventional art cannot prevent it from occurring that the relay is temporality turned to OFF and power supply from the relay to a load is accordingly cut off.

In view of this, another conventional art supplies the coil with a holding current which has such excessive a current value that the external disturbance cannot detach the plate from the coil. With this conventional art, the relay is not turned to OFF because of some external disturbance resulting from certain usages of the relay and steady external disturbances resulting from degradation of the relay.

In this conventional art, the relay consumes much power because it is supplied with the holding current acting as a measure against the external disturbance even if the external disturbance is not occurring. In addition, the relay and a relay drive circuit produce much heat, which may harm a primary purpose of the relay and the relay drive circuit to reduce an amount of heat produced by the relay and the relay drive.

SUMMARY OF THE INVENTION

It is therefore an object of the present invention to provide a relay drive circuit which suppresses power consumption and also reduces a possibility that the external disturbance turns the relay to OFF.

A relay drive circuit according to an aspect of the present invention includes a first drive portion, a second drive portion, a current switching portion, and a plate-OFF detecting portion. The first drive portion sets a coil current to be supplied to a coil to a first current value with which a plate of an electromagnetic relay is drawn and a movable contact of the relay comes in contact with a fixed contact of the relay.

The second drive portion sets the coil current to a second current value which is smaller than the first current value set by the first drive portion, so that the movable contact and the fixed contact are kept in contact with each other.

The current switching portion between supplying the coil with the coil current having the first current value set by the first drive portion and supplying the coil with the coil current having the second current value set by the second drive portion.

The plate-OFF detecting portion detects, based on change of a potential at an end of the coil, OFF-tendency in which the plate is about to get apart from a head of a core of the relay.

In addition, the current switching portion switches to supplying the coil with the coil current having the first current value set by the first drive portion, when the plate-OFF detecting portion detects the OFF-tendency.

As described above, when the plate-OFF detecting portion detects the OFF-tendency, the coil current is set to the first current value before the movable contact gets apart from the fixed contact. Thus, the coil is supplied with the coil current having the first current value. Therefore, although the relay drive circuit can prevent the sudden external disturbance from occurring, it is not necessary to keep supplying the coil 4*a* with a current having a value acting as a measure against the external disturbance while the external disturbance is not occurring.

Therefore, the relay drive circuit can prevent the relay from turning to OFF caused by the sudden external disturbance, without necessity of keeping supplying the coil with a current having a value acting as a measure against the external disturbance even while the external disturbance is not occurring. Therefore, the relay drive circuit can reduce the possibility that the relay is turned to OFF by the external disturbance, and can suppress the power consumption.

For example, in the case that the current switching portion is located at a low-side of the relay and drives the relay through the low-side, the plate-OFF detecting portion may detect the OFF-tendency based on change of a potential at the low-side of the coil. The low-side is one of two ends of the coil having lower potential than the other one of the two ends. In this case, the plate-OFF detecting portion may include a highpass filter for passing only high frequency components in the potential at the low-side of the coil, and the plate-OFF detecting portion may detect the OFF-tendency when change of the high frequency components is larger than a threshold.

In contrast, in the case that the current switching portion is located at a high-side of the relay and drives the relay through the high-side, the plate-OFF detecting portion may detect the OFF-tendency based on change of a potential at the high-side of the coil. The high-side is one of two ends of the coil having higher potential than the other one of the two ends. In this case, a capacitor serving as a highpass filter can be disused since the potential at the high-side of the coil does not sensitively change according to the change of a power source.

In another aspect of the present invention, the drive circuit includes an optimum current setting portion for controlling the current switching portion so that the second current value becomes optimal. In addition, the optimum current setting portion sets, when the plate-OFF detecting portion detects the OFF-tendency while the coil current with the second current value is being supplied to the coil, a new value as the second current value which is larger than an old value set as the second current value before detection the OFF-tendency.

A value which the second current value takes when the OFF tendency is detected corresponds to a required current value which is the minimum value to keep the plate from being pulled apart from the head of the core. It is thus possible to watch the required current value without a specially made sensor. By setting the second current value again to a value larger than the required current value, the second current value becomes optimal.

Therefore, the relay drive circuit can prevent the relay from turning to OFF caused by the regular (or constant) external disturbance, without necessity of keeping supplying the coil with a current having a value acting as a measure against the external disturbance even while the external disturbance is not occurring. Therefore, the relay drive circuit can reduce the possibility that the relay is turned to OFF by the external disturbance and can suppress the power consumption.

For example, the first drive portion may set, when the relay switch is turned to ON, the coil current to the first current value so as to draw the plate so that the movable contact comes in contact with the fixed contact. The optimum current setting portion may subsequently decrease a current value of the coil current gradually from the first current value. The optimum current setting portion may set, on detecting the OFF-tendency in decreasing the current value of the coil current, the new value as the second current value which is larger than a certain value being the second current value at the detection the OFF-tendency.

The first drive portion may set, when the plate-OFF detecting portion detects the OFF-tendency, the coil current to the first current value so as to draw the plate so that the movable contact comes in contact with the fixed contact. The optimum current setting portion may subsequently decrease a current value of the coil current gradually from the first current value. The optimum current setting portion may set, on detecting the OFF-tendency in decreasing the current value of the coil current, the new value as the second current value which is larger than the old value set as the second current value before the detection the OFF-tendency.

In the case that the coil current is decreased to the second current value immediately after the transition to a first state for supplying the first current value to the coil, the relay drive circuit works well if the required current value does not change in the first state. However, if the required current value changes in the first state, the second current value may be exceeded by the changed required current value when the relay drive circuit decrease the coil current to the second current value. By gradually decreasing the coil current from the first current value to the second current value, it is possible to set again a new second current value according to the changed required current value, even if the required current value changes.

For example, the optimum current setting portion may include a D/A converter for generating a potential corresponding to a counter value and an optimum current control portion for counting the counter value. In this case, the relay drive circuit may change the potential outputted by the D/A converter by changing the counter value of the optimum current control portion so as to decrease the current value of the coil current gradually from the first current value.

Thus, it is possible to detect the required current value every time by using a counter to decrease gradually the coil current after supplying, every time when the plate-OFF detecting portion detects the OFF tendency, the coil with the coil current having first current value. It is therefore unnecessary to memorize in an EEPROM or the like a previously set value for the second current value.

In a likewise manner, the optimum current setting portion may include an optimum current control portion including a counter for counting a counter value. In this case, the current switching portion may include a constant current D/A converter for executing weighting based on the counter value so as to change a value of a current to output. In addition, the relay drive circuit may change the value of the current outputted by the constant current D/A converter by changing the counter value of the optimum current control portion so as to decrease the current value of the coil current gradually from the first current value. An effect similar to the above is attained with this operation.

It is possible to construct an electric connection box which gathers the relay drive circuit, the relay, a wiring member, and a case, wherein the case includes the wiring member and accommodates the relay drive circuit and the relay. Thus, it is possible to install the relay drive circuit and relay into the same electric connection box. In the case that the relay drive circuit and the relay are incorporated in the same box, it is easier to arrange wiring than in the case that the relay drive circuit and the relay are incorporated in separate boxes. Besides, in the case that the relay drive circuit and the relay are incorporated in the same box, it is not necessary to use wire harnesses.

BRIEF DESCRIPTION OF THE DRAWINGS

The invention, together with additional objective, features and advantages thereof, will be best understood from the following description, the appended claims and the accompanying drawings. In the drawings:

DETAILED DESCRIPTION OF THE EMBODIMENTS

Figure 1:
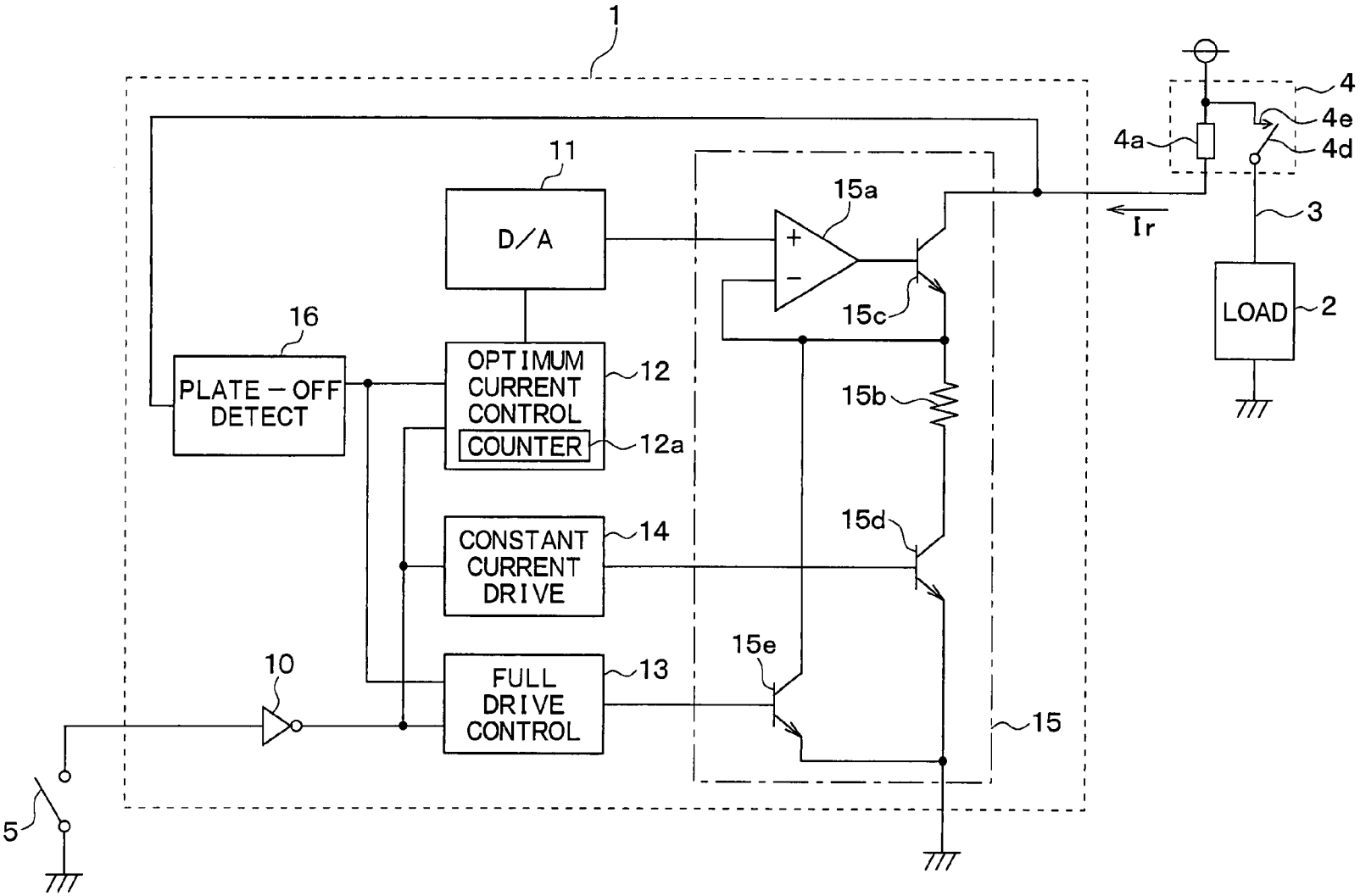
FIG. 1 is a schematic diagram showing a circuit structure of a relay drive circuit according to a first embodiment of the present invention.

Embodiments of the present invention will be described with reference to the drawings. In the drawings, a common reference number is given to portions in different embodiments if the portions are identical or almost identical to each other.

First Embodiment

Hereinafter, a structure of a relay drive circuit 1 according to a first embodiment of the present invention is described with reference to FIG. 1.

As shown in FIG. 1, an electromagnetic relay 4 is provided which turns on and off power supply to a load 2 through a power supply line 3. The relay drive circuit 1 is for controlling power supply to a coil 4*a* which is included by the relay 4. The relay drive circuit 1 is connected with an end of the relay 4. More specifically, the relay drive circuit 1 is located at the low-side of the relay 4 and drives relay 4 from the low-side.

Figure 2A:
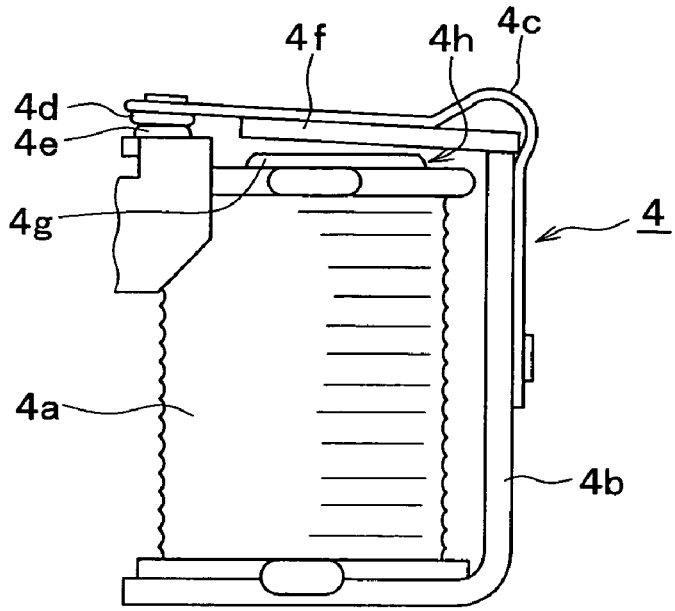
FIG. 2A is a side view of a detailed structure of an electromagnetic relay in an OFF state.
Figure 2B:
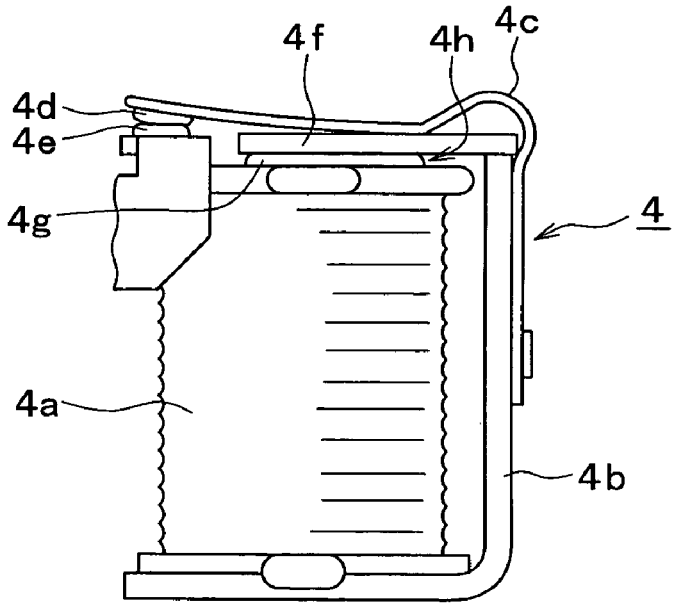
FIG. 2B is a side view of the detailed structure of the electromagnetic relay in an ON state.

FIGS. 2A and 2B are side views of a detailed structure of the relay 4 in OFF and ON state, respectively.

As shown in FIGS. 2A and 2B, the relay 4 includes the coil 4*a*, a yoke portion 4*b*, a plate spring 4*c*, a movable contact 4*d*, a fixed contact 4*e*, a plate 4*f*, and a core 4*h*. The core 4*h* includes a core head 4*g* at its head end. The yoke portion 4*b* bears the coil 4*a*. The plate spring 4*c* is fixed at its base end to a top surface (, or a vertical surface) of the yoke portion 4*b*. The movable contact 4*d* is attached to a surface of a head end portion of the plate spring 4*c*. The fixed contact 4*e* is attached to a lateral end portion of the coil 4*a* and faces the movable contact 4*d*. The plate 4*f* is composed of magnetic material and is attached to a surface of a middle portion of the plate spring 4*c*. The core 4*h* is inserted in the coil 4*a* and faces the plate 4*f*.

When the power supply to the coil 4*a* is shut, an elastic force of the plate spring 4*c* draws the plate 4*f* apart from the core head portion 4*g*, as shown in FIG. 2A. The movable contact 4*d* subsequently gets apart from the fixed contact 4*e* and the relay 4 is turned to OFF. When electrical power is supplied to the coil 4*a*, the plate 4*f* is drawn to come in contact with the core head portion 4*g*, as shown in FIG. 2B, because a magnetic attracting force of the coil 4*a* becomes stronger than the elastic force of the plate spring 4*c*. The movable contact 4*d* accordingly comes in contact with the fixed contact 4*e* and the relay 4 is turned ON.

The relay drive circuit 1 controls operation of the relay 4 and also reduces a possibility that the relay 4 is turned to OFF even if the plate 4*f* starts to be drawn apart from the core head portion 4*g* because of an external disturbance.

More specifically, the relay drive circuit 1 includes, as shown in FIG. 1, a NOT circuit 10, a D/A converter 11, an optimum current control portion 12, a full drive control portion 13, a constant current drive portion 14, a current switching circuit portion 15, and a plate-OFF detecting portion 16.

The NOT circuit 10 inverts the electrical potential of the ground (i.e. Low) to Hi and apply the Hi electrical potential to the optimum current control portion 12, the full drive control portion 13, and the constant current drive portion 14, when a relay switch 5 is pressed by a user.

The D/A converter 11 and the optimum current control portion 12 serve as an example of an optimum current setting portion of the present invention.

The D/A converter 11 outputs a reference voltage to an operational amplifier 15*a* described later. The D/A converter 11 can change the value of the reference voltage within a range, for example, from 0V to 5V. An amount of a holding current used to maintain an ON state of the relay 4 changes according to the reference voltage outputted by the D/A converter 11.

The optimum current control portion 12 sets a value for the reference voltage outputted by the D/A converter 11 so that a coil current Ir to be supplied to the coil 4*a* achieves an optimally controlled current amount. For example, the optimum current control portion 12 may include a counter 12*a* and output to the D/A converter 11 a control signal indicating a counter value stored by the counter 12*a*. The counter value of the counter 12*a* is for controlling the reference voltage outputted by the D/A converter 11 and therefore corresponds to the voltage value of the reference voltage. When the optimum current control portion 12 outputs the control signal, the D/A converter 11 outputs the reference potential having the voltage value which corresponds to the counter value indicated by the control signal.

When the plate-OFF detecting portion 16 detects OFF-tendency in which the plate 4*f* is about to be drawn apart from the core head portion 4*g*, the optimum current control portion 12 receives from the plate-OFF detecting portion 16 a signal indicating the OFF-tendency. The optimum current control portion 12 then stores at this time the counter value of the counter 12*a* and thereafter outputs to the D/A converter 11 the control signal indicating the counter value having a value larger than the stored value by two. Thus, the optimum current control portion 12 makes the D/A converter 11 increase the value of the reference voltage compared to that before detecting the OFF-tendency so that the amount of the holding current to the coil 4*a* becomes larger.

Each of the D/A converter 11 and the optimum current control portion 12 may be constructed by, for example, a single microcomputer.

The full drive control portion 13 serves as an example of a first drive portion. The full drive control portion 13 controls, in turning the relay 4 from OFF to ON, the current switching circuit portion 15 so that the coil 4*a* is supplied, for a predetermined fixed period, from a power source with the coil current Ir having the maximum current value (, or a full supply current value). The maximum current value is an example of a first current value. More specifically, when the user operates the relay switch 5 to turn the relay 4 from OFF to ON, the Hi potential is applied through the NOT circuit 10 to the full drive control portion 13. The full drive control portion 13 then detects that the potential at its terminal connected with the NOT circuit 10 is switched to Hi and accordingly outputs the Hi potential for the fixed period to the current switching circuit portion 15.

The full drive control portion 13 controls, when the external disturbance occurs and the relay 4 is about to be turned from ON to OFF, the current switching circuit portion 15 so that the coil 4*a* is supplied from a power source with the coil current Ir having the maximum current value. More specifically, when the plate-OFF detecting portion 16 detects the OFF-tendency, the potential outputted by the plate-OFF detecting portion 16 is switched to Low as described later. The full drive control portion 13 then detects that the potential at its another terminal connected to the plate-OFF detecting portion 16 is switched to Low and accordingly outputs the Hi potential for the fixed period to the current switching circuit portion 15.

The constant current drive portion 14 serves as an example of a second drive portion. The constant current drive portion 14 controls, in maintaining the ON state of the relay 4, the current switching circuit portion 15 so that the coil 4*a* is supplied with a holding current as the coil current Ir. The holding current is set to have a current value smaller than the maximum current value. The coil current Ir can be the holding current in this case because a current value required to maintain the ON state of the relay 4 is relatively small. More specifically, when the user operates the relay switch 5 to turn the relay 4 from OFF to ON, the Hi potential is applied through the NOT circuit 10 to the constant current drive portion 14. The constant current drive portion 14 then detects that the potential at its terminal connected with the NOT circuit 10 is switched to Hi and thereafter outputs the Hi potential constantly to the current switching circuit portion 15.

The current switching circuit portion 15 serves as an example of a current switching portion and switches between supplying the coil 4*a* with the coil current Ir with the maximum current value and supplying the coil 4*a* with the holding current. The current switching circuit portion 15 is located to the low-side of the relay 4. More specifically, the current switching circuit portion 15 includes an operational amplifier 15*a*, a resistor 15*b*, and first to third transistors 15*c* to 15*e*.

The operational amplifier 15*a* installed so that its non-inverting input terminal receives the output voltage (i.e. the reference voltage) of the D/A converter 11, its inverting input terminal receives a potential from the emitter terminal of the first transistor 15*c*, and from its output terminal the base current of the first transistor 15*c* is outputted.

The resistor 15*b* has a fixed resistance value and is for reducing the amount of the coil current Ir to be supplied from a power source to the coil 4*a* of the relay 4.

The first transistor 15*c* having a collector terminal connected with a terminal of the coil 4*a* is used for controlling the coil current Ir to be supplied to the coil 4*a*.

The second and third transistors 15*d* and 15*e* are driven by the constant current drive portion 14 and the full drive control portion 13, respectively. The second transistor 15*d* is turned to ON when the constant current drive portion 14 outputs the Hi potential. The third transistor 15*e* is turned to ON when the full drive control portion 13 outputs the Hi potential. When the second transistor 15*d* is in the ON state and the third transistor 15*e* is in the OFF state, the coil current Ir is supplied through the resistor 15*b* and the coil 4*a* is therefore supplied with the holding current having the current value (which is an example of the second current value) smaller than the maximum current value. When the second transistor 15*d* is in the ON (or OFF) state and the third transistor 15*e* is in the ON state, the coil current Ir is supplied bypassing the resistor 15*b* and the coil 4*a* is therefore supplied with the coil current Ir having the maximum current value.

Since the reference voltage from the D/A converter 11 is changeable, the base current for the first transistor 15*c* is controlled so that the emitter potential of the first transistor 15*c* becomes closer to the reference voltage. Thus, the collector current for the first transistor 15*c*, that is, the electrical coil current Ir supplied to the coil 4*a*, is adjusted to have an optimum current value.

The plate-OFF detecting portion 16 senses a potential of a terminal (more specifically, the low-side terminal) of the coil 4*a* and detects the OFF-tendency based on the sensed potential. On detecting the OFF-tendency, the plate-OFF detecting portion 16 notifies the optimum current control portion 12 and the full drive control portion 13 of the detection of the OFF-tendency before the plate 4*f* gets apart from the core head portion 4*g*. More specifically, the plate-OFF detecting portion 16 has a circuit structure shown in FIG. 3.

Figure 3:
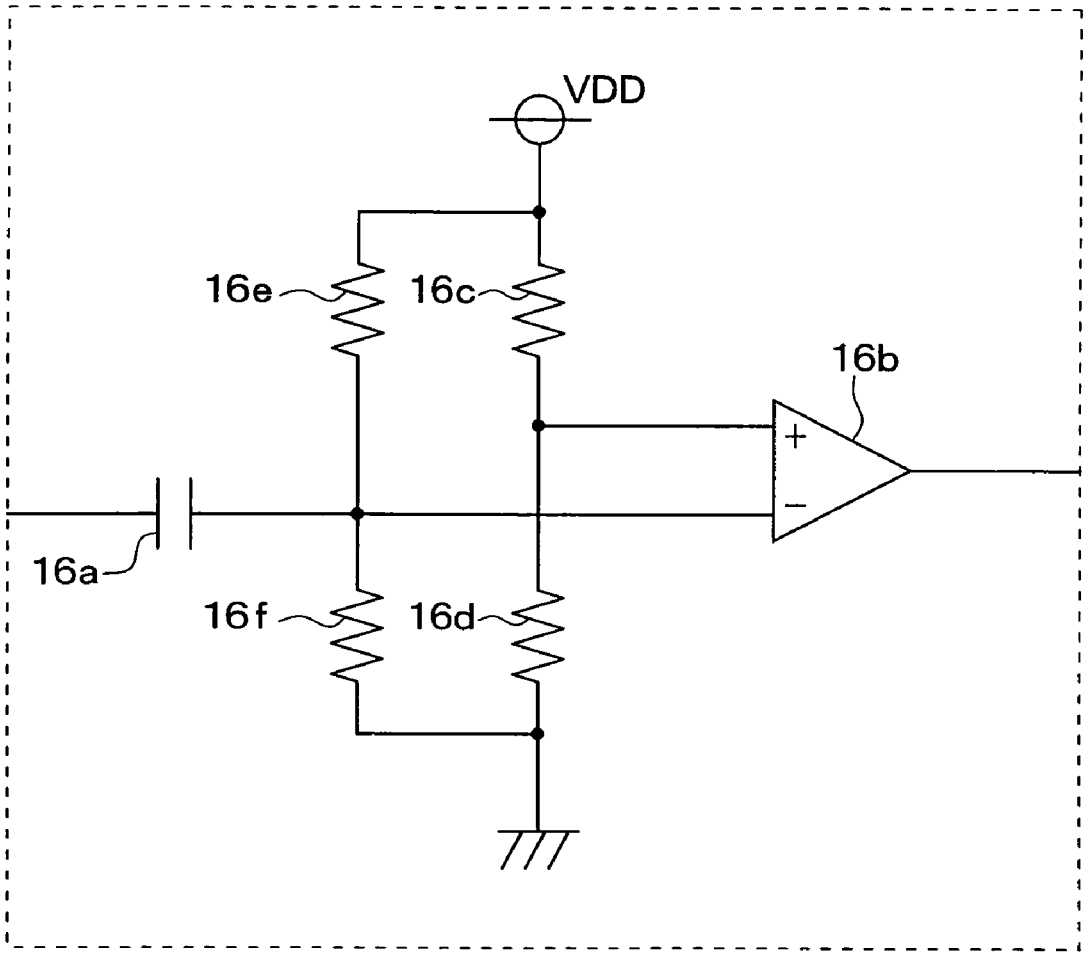
FIG. 3 is a schematic diagram showing a circuit structure of a plate-OFF sensing portion of the relay drive circuit shown in FIG. 1.

As shown in FIG. 3, the plate-OFF detecting portion 16 includes a capacitor 16*a*, comparator 16*b*, and resistors 16*c* to 16*f*. The resistors 16*c* and 16*d* together constitute a resistor voltage divider for setting a threshold potential. The resistors 16*e* and 16*f* together constitute another resistor voltage divider for producing an intermediate potential.

When the potential from the terminal of the coil 4*a* is applied to the plate-OFF detecting portion 16, the capacitor 16*a* plays a role to block the DC component of the potential and pass only an AC component (, or a high frequency component). The capacitor 16*a* also plays a role of a highpass filter, with which the plate-OFF detecting portion 16 does not sense the potential from the coil 4*a* if the change rate of the potential is smaller than a certain threshold rate and senses the potential if the change rate is larger than the threshold rate.

The resistor voltage divider 16*c*-16*d* and the resistor voltage divider 16*e*-16*f* perform voltage dividing of the voltage VDD from the constant-voltage source. The potential resulting from the voltage dividing of the resistor voltage divider 16*c*-16*d* is inputted to the non-inverting input terminal of the comparator 16*b*. The potential resulting from the voltage dividing of the resistor voltage divider 16*e*-16*f* is inputted to the inverting input terminal of the comparator 16*b*. The potential, which results from voltage dividing of the resistor voltage divider 16*e*-16*f* and is inputted to the inverting input terminal, is the intermediate potential which is added to the AC component coming through the capacitor 16*a*. The potential, which result from voltage dividing of the resistor voltage divider 16*c*-16*d* and inputted to the non-inverting input terminal, is the threshold potential.

The comparator 16*b* compares the threshold potential set by the resistor voltage divider 16*c*-16*d* with a changing potential and outputs a signal based on the result of the comparison. The changing potential is the sum of the intermediate potential (which is a potential at an intermediate point) and the AC component coming through the capacitor 16*a* (that is, a changing component of the potential at the end of the 4*a*). More specifically, the comparator 16*b* outputs the Low potential when the changing potential is higher than the threshold potential and outputs the Hi potential when the changing potential is lower than the threshold potential.

Thus, the plate-OFF detecting portion 16 uses the potential of a terminal of the coil 4*a* as a potential to sense and detects whether there is the OFF-tendency by comparing the threshold potential with the changing potential including the AC component of the sensed potential.

When the plate 4*f* is biased in the direction apart from the core head portion 4*g*, the inductance of the coil 4*a* changes. This significantly changes a current value (hereinafter referred to an Ir required value) of the coil current Ir which is necessary in order to prevent the plate 4*f* from getting apart from the core head portion 4*g*. This also changes the voltage between the both ends of the coil 4*a*. In view of this phenomenon, the plate-OFF detecting portion 16 is made to monitor the Ir required value for the coil 4*a* by using the low-side potential of the coil 4*a* (which corresponds to the voltage between both ends of the coil 4*a*) as the potential to sense and by detecting the OFF-tendency based on the sensed potential.

Hereinafter, an example of the operation of the relay drive circuit 1 according to the present embodiment will be described with reference to the timing chart in FIG. 4.

The Low potential is applied to the optimum current control portion 12, the full drive control portion 13, and the constant current drive portion 14 before a user presses the relay switch 5. Both the second transistor 15*d* and the third transistor 15*e* are hence in the OFF states and the coil current Ir is not supplied to the coil 4*a* of the relay 4. Therefore, the plate 4*f* is apart from the core head portion 4*g*, the movable contact 4*d* is apart from the fixed contact 4*e*, and the relay 4 is in the OFF state. Thus, power supply line 3 to the load 2 is in the OFF state and the load 2 is not supplied with the electric power.

When a user presses the relay switch 5, the Hi potential is applied through the NOT circuit 10 to the optimum current control portion 12, the full drive control portion 13, and the constant current drive portion 14. This makes the full drive control portion 13 and the constant current drive portion 14 output the Hi potential respectively to the third transistor 15*e* and the second transistor 15*d*, and the second and third transistors 15*d* and 15*e* turns to ON. At the same time, the optimum current control portion 12 outputs the control signal indicating a maximum counter value so that the reference potential outputted by the D/A converter 11 becomes the maximum value. Thus, the reference potential from the D/A converter 11 is set to the maximum value (for example, 5V). Accordingly, the relay drive circuit 1 gets into a full power supply state in which the coil current Ir for the coil 4*a* goes through the third transistor 15*e* and the value of the coil current Ir reaches at its maximum, as shown in a period T1 in FIG. 4.

Therefore, the magnetic attracting force of the coil 4*a* becomes more dominant than superior to the elastic force of the plate spring 4*c*, the plate 4*f* is pulled to come into contact with the core head portion 4*g*, the movable contact 4*d* comes into contact with the fixed contact 4*e*, and the relay 4 is turned to ON. The power supply line 3 is accordingly becomes ON and the load 2 starts being supplied with the electric power.

Figure 4:
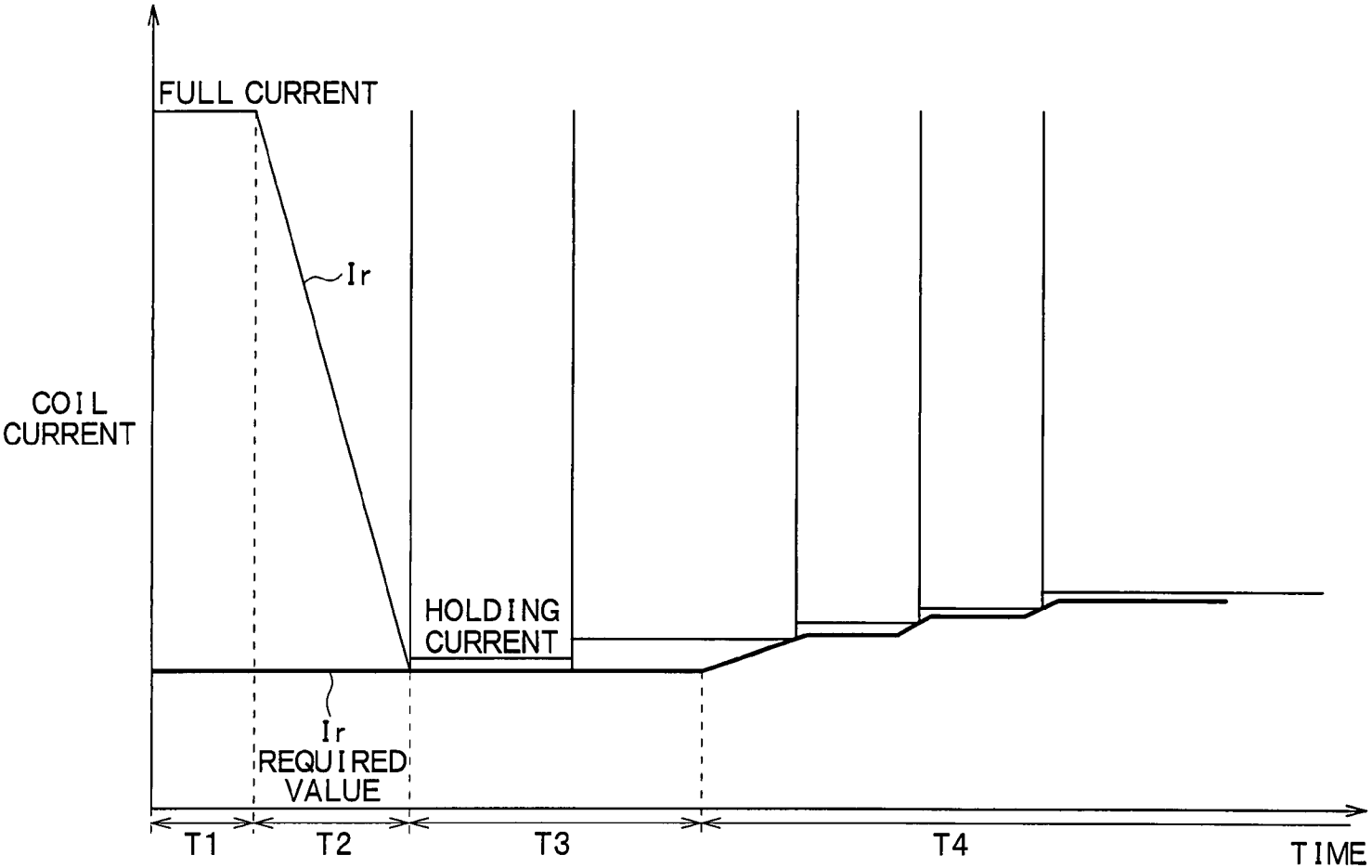
FIG. 4 is a timing chart showing an example of the operation of the relay drive circuit.

After a period, within which the relay 4 is supposed to have tuned to ON, a period T2 shown in FIG. 4 begins. At the start of the period T2, the potential outputted by the full drive control portion 13 is turned from Hi to Low, while the potential outputted by the constant current drive portion 14 is kept Hi. At the same time, the optimum current control portion 12 starts decreasing the counter value for outputting to the D/A converter 11 gradually from the maximum counter value. Therefore, the reference potential from the D/A converter 11 is gradually decreased, and the coil current Ir for the coil 4*a* is accordingly decreased gradually from an initial current value. The initial current value can be, for example, the maximum current value. In this process the plate-OFF detecting portion 16 does not detect the OFF-tendency even if the potential at the low-side of the relay 4 changes, because a change rate of the coil current Ir in this process is sufficiently smaller than a change rate of the coil current Ir in the external disturbance.

As the coil current Ir is decreased gradually, it approaches to the Ir required value. When the coil current Ir becomes equal to the Ir required value, the plate-OFF detecting portion 16 detects the OFF-tendency and changes the potential for outputting to the optimum current control portion 12 and full drive control portion 13 from Hi to Low.

The full drive control portion 13 accordingly detects the OFF-tendency and turns the third transistor 15*e* to ON in order to achieve the full power supply state for a constant period. The optimum current control portion 12 memorizes the counter value at the time of detection of the OFF-tendency and outputs to the D/A converter 11 the control signal indicating a value larger than the memorized counter value by, for example, two.

As described above, after the detection of the OFF-tendency the relay drive circuit 1 is in the full power supply state for a constant period in which the full drive control portion 13 operates to keep the coil current Ir at its maximum. After the constant period, the value of the reference voltage from the D/A converter 11 is set to a higher value than a value of the reference voltage at a time just before the OFF-tendency is detected. Therefore, after the constant period, the holding current is modified so that it has a certain margin. Thus, the relay drive circuit 1 transits from the full power supply state to a state in which the holding current supplied to the coil 4*a*.

Thus, the ON state of the relay 4 is maintained by the holding current to the coil 4*a*, the value of which is smaller than the maximum value and slightly larger than the Ir required value. Therefore, power consumption of the relay drive circuit 1 and relay 4 is suppressed.

Suppose that the sudden external disturbance occurs in a period T3 shown in FIG. 4, after the holding current is set. In this case, change of the inductance of the coil 4*a* causes the coil current Ir to change rapidly. The plate-OFF detecting portion 16 detects the change of the coil current Ir and switch the potential for outputting to the optimum current control portion 12 and the full drive control portion 13 from Hi to Low.

The full drive control portion 13 accordingly detects the OFF-tendency and turns the third transistor 15*e* to ON. In addition, the optimum current control portion 12 memorizes the counter value at the time of detection of the OFF-tendency and outputs to the D/A converter 11 the control signal indicating a value larger than the memorized counter value by, for example, two.

Similar to above, after the detection of the OFF-tendency the relay drive circuit 1 is in the full power supply state for a constant period in which the full drive control portion 13 operates to keep the coil current Ir at its maximum. After the constant period, the value of the reference voltage from the D/A converter 11 is set to a higher value than a value of the reference voltage at a time just before the OFF-tendency is detected. Therefore, after the constant period, the holding current is modified so that it has a new current value having a certain margin. Thus, even if the sudden external disturbance occurs, the relay drive circuit 1 can prevent the relay 4 from being turned to OFF by momentarily supplying the coil 4*a* with the coil current Ir having the maximum value.

Figure 5:
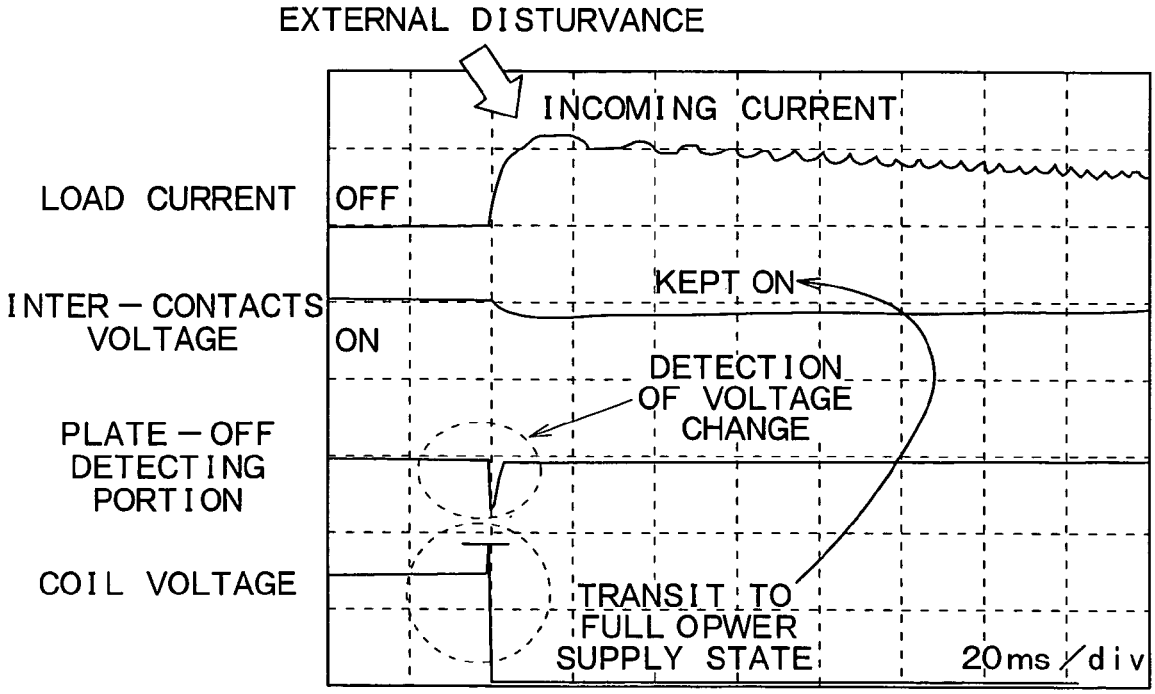
FIG. 5 is a timing chart in a case where a sudden external disturbance occurs.

FIG. 5 is a timing chart showing electrical states of several portions of the relay drive circuit 1 and relay 4 in a period around the occurrence of the sudden external disturbance. As shown in FIG. 5, the inductance of the coil 4*a* changes and the voltage between both ends of the coil 4*a* accordingly changes when the sudden external disturbance (, or incoming current) occurs. At the moment, the potential outputted by the plate-OFF detecting portion 16 changes to Low, and the relay drive circuit 1 transits to the full power supply state.

After that, the plate-OFF detecting portion 16 detects the OFF-tendency again in a period T4 shown in FIG. 4, when a regular disturbance such as temperature variation changes the Ir required value to a value larger than the holding current at the time.

When the Ir required value changes and exceeds the holding current, the plate-OFF detecting portion 16 detects, in the same manner described in the case of the sudden external disturbance, the OFF-tendency and the switch the potential for outputting to the optimum current control portion 12 and the full drive control portion 13 from Hi to Low.

The full drive control portion 13 accordingly detects the OFF-tendency and turns the third transistor 15*e* to ON. In addition, the optimum current control portion 12 memorizes the counter value at the time of detection of the OFF-tendency and outputs to the D/A converter 11 a kind of the control signal indicating a value larger than the memorized counter value by, for example, two.

Similar to above, after the detection of the OFF-tendency the relay drive circuit 1 is in the full power supply state for a constant period in which the full drive control portion 13 operates to keep the coil current Ir at its maximum. After the constant period, the value of the reference voltage from the D/A converter 11 is set to a higher value than a value of the reference voltage at a time just before the OFF-tendency is detected. Therefore, after the constant period, the holding current is modified so that it has a new current value having a certain margin. Thus, a value is set to the holding current in the case that the Ir required value changes caused by the regular disturbance.

As described above, the relay drive circuit 1 according to the present embodiment transits to the full power supply state in which the relay drive circuit 1 momentarily maximizes the coil current Ir for supplying to the coil 4*a* when the sudden external disturbance occurs. In addition, the relay drive circuit 1 reduces the coil current Ir to the holding current when the sudden external disturbance ends. Therefore, the relay drive circuit 1 can prevent the relay 4 from turning to OFF caused by the sudden external disturbance, without necessity of keeping supplying the coil 4*a* with a current having a value acting as a measure against the external disturbance even while the external disturbance is not occurring.

Therefore, the relay drive circuit 1 can reduce the possibility that the relay 4 is turned to OFF by the external disturbance and suppress the power consumption.

In the relay drive circuit 1 of the present embodiment, the plate-OFF detecting portion 16 detects the Ir required value by monitoring the potential of the low-side of the coil 4*a*, and the optimum current control portion 12 adjusts the coil current Ir to a suitable value for the holding current based on the detected Ir required value. Therefore, the relay drive circuit 1 can prevent the regular external disturbance from wrongly turning the relay 4 to OFF while keeping the value of the holding current for maintaining the ON state of the relay 4 as small as possible. Thus it is possible to further suppress the power consumption.

Second Embodiment

Hereinafter, the second embodiment of the present invention will be described. The relay drive circuit 1 of the present embodiment differs from the relay drive circuit 1 of the first embodiment in the operation of the relay drive circuit 1 after the plate-OFF detecting portion 16 detects the OFF-tendency and the relay drive circuit 1 transits to the full power supply state. The description below is only for a part of the present embodiment which differs from the first embodiment.

In the present embodiment, the relay drive circuit 1 does not immediately decrease, after the transition to the full power supply state, the coil current Ir to a new holding current having a new counter value larger by two than the old counter value corresponding to the old holding current just before the detection of the OFF-tendency. The relay drive circuit 1 according to the present embodiment decreases the coil current Ir gradually from an initial current value down to the new holding current after the transition to the full power supply state. The initial current value can be, for example, the maximum current value.

More specifically, the optimum current control portion 12 increases, on detecting the OFF-tendency, the counter value to be outputted to the D/A converter 11 to the maximum counter value and decreases after a constant period the counter value gradually from the maximum counter value to a new counter value larger by two than the old counter value corresponding to the old holding current just before the detection of the OFF-tendency.

In the case that the coil current Ir is decreased to the new holding current immediately after the transition to the full power supply state in which the coil current Ir is maximized, the relay drive circuit 1 works well if the Ir required value does not change in the full power supply state. However, if the Ir required value changes in the full power supply state, the new holding current may be exceeded by the changed Ir required value when the relay drive circuit 1 decreases the coil current Ir to the new holding current. By gradually decreasing the coil current Ir from its maximum to the new holding current, it is possible to set again a further new holding current according to the changed Ir required value, even if the required value changes.

Figure 6A:
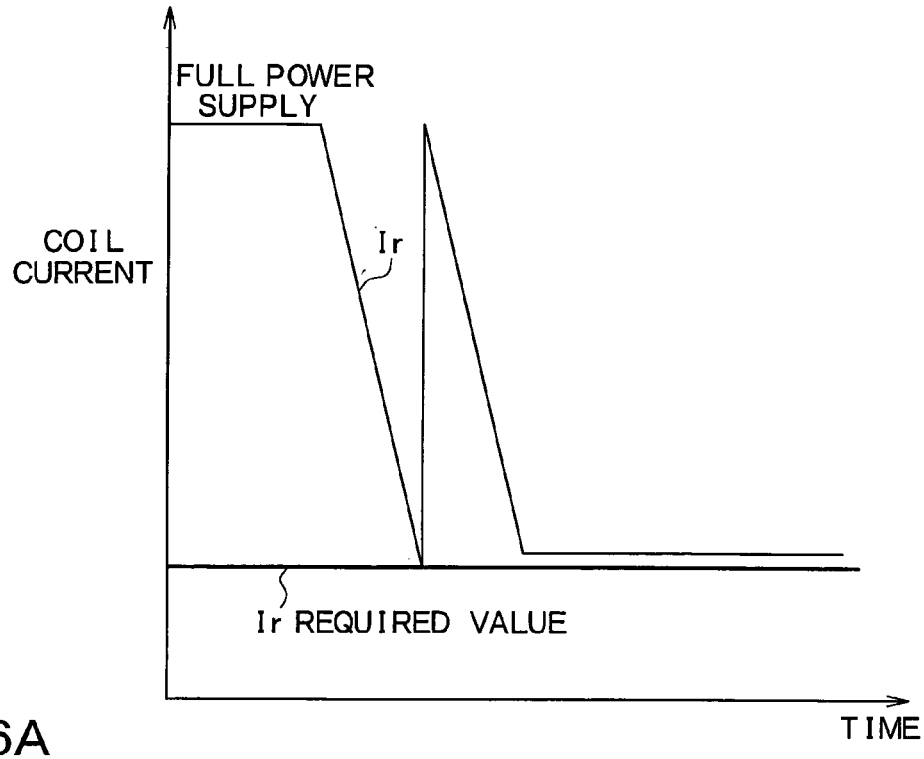
FIG. 6A is a timing chart in a case where an Ir required value does not change while an electric current Ir is being reduced from its maximum to a holding current.
Figure 6B:
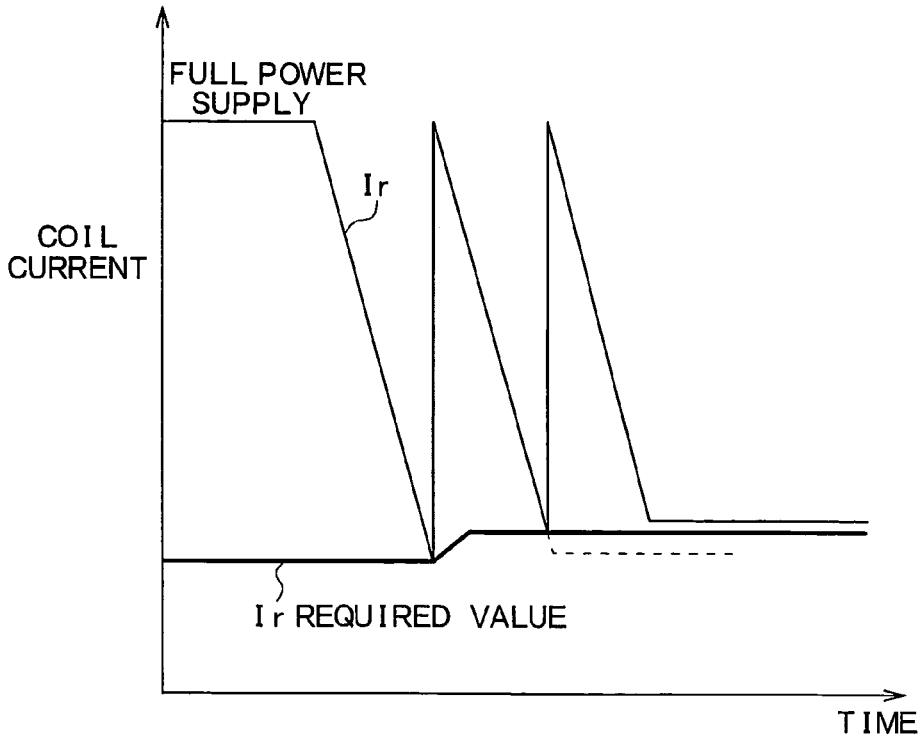
FIG. 6B is a timing chart in a case where the Ir required value changes while the electric current Ir is being reduced from its maximum to the holding current.

FIGS. 6A and 6B are timing charts showing examples of the change of the coil current Ir for the coil 4*a* in this embodiment. In the example shown in FIG. 6A, the Ir required value does not change while the coil current Ir is being reduced from its maximum to the holding current. In the example shown in FIG. 6B, the Ir required value changes while the coil current Ir is being reduced from its maximum to the holding current. As shown in these drawings, if the Ir required value does not change, the coil current Ir is decreased and kept to the new holding current corresponding to the new counter value larger by two than the old counter value of the counter 12*a* in the optimum current control portion 12 just before detecting the OFF-tendency. In contrast, if the Ir required value increases to exceed the new holding value, the further new holding value larger than the increased Ir required value is set again and therefore it is possible to prevent the change of the Ir required value wrongly turning the relay 4 to OFF.

Third Embodiment

Hereinafter, the third embodiment of the present invention will be described. In the present embodiment an arrangement of the relay drive circuit 1, the relay 4, and an electric connection box in which the relay drive 25 circuit 1 and the relay 4 are incorporated differs from the first and second embodiments. The structures of the relay drive circuit 1 and the like are the same as those in the first and second embodiments. Only the configuration of the relay drive circuit 1, the relay 4, and the electric connection box is described below.

Figure 7:
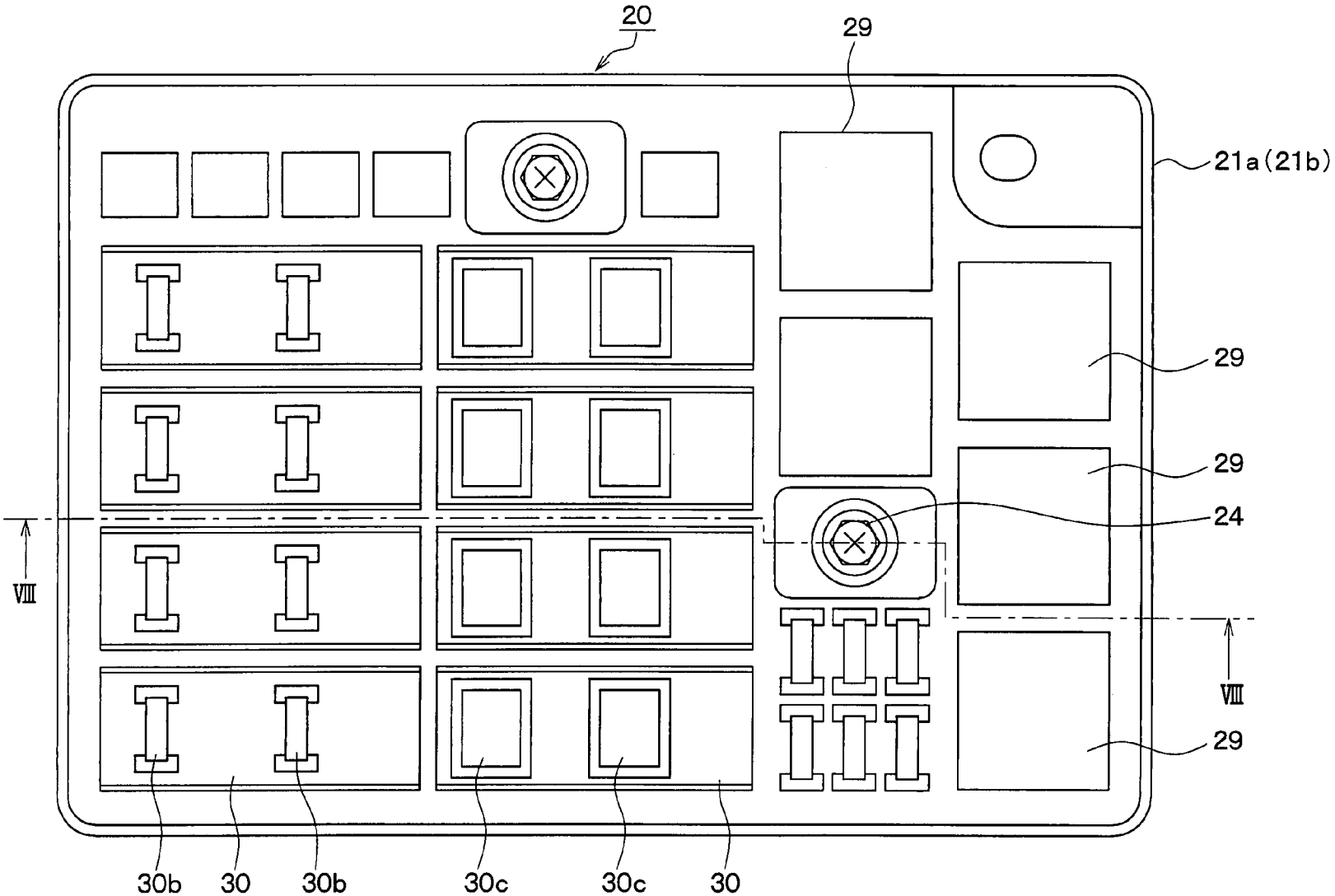
FIG. 7 is a schematic top view of an electric connection box.
Figure 8:
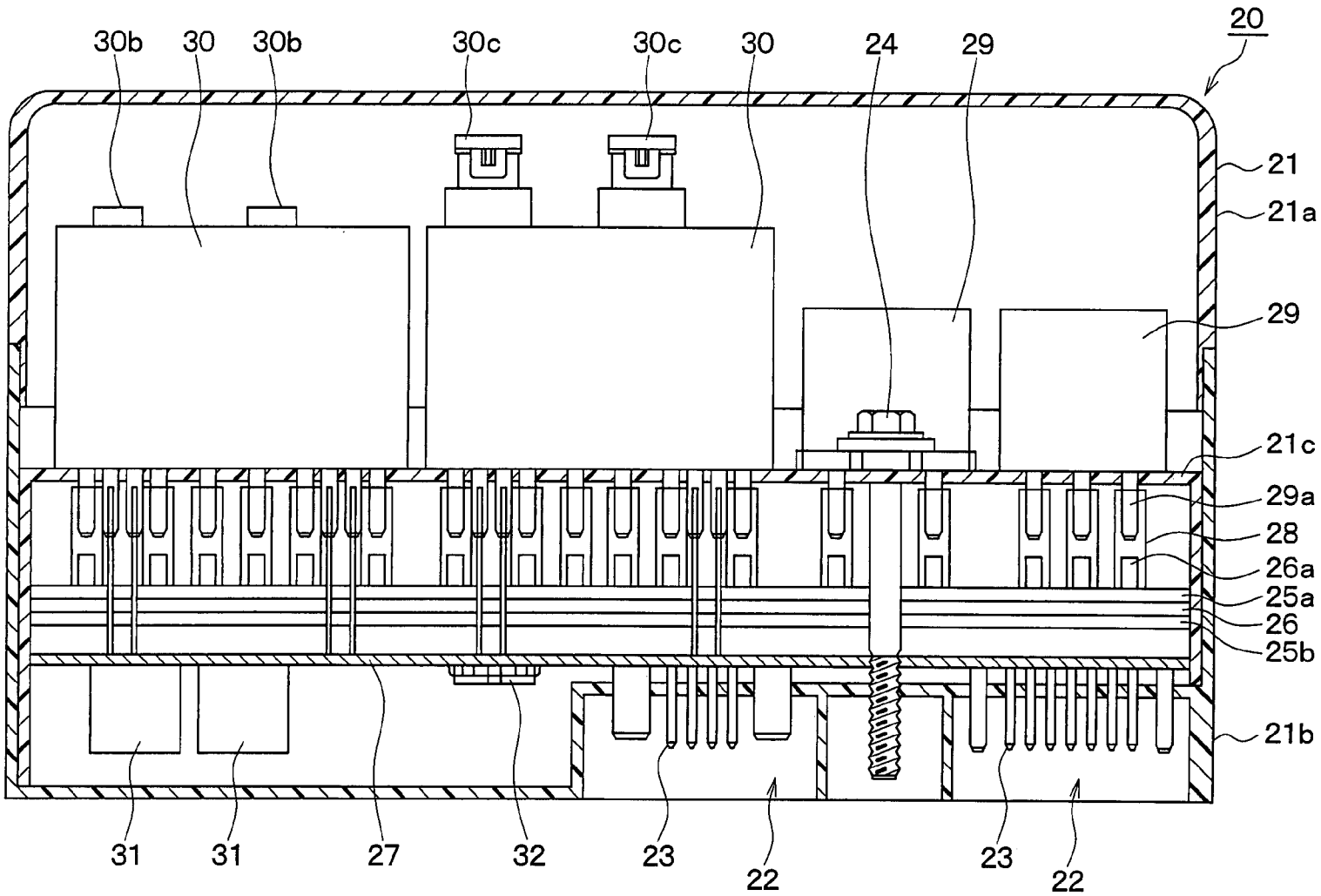
FIG. 8 is a cross sectional view of the electric connection box taken along the line VIII-VIII in FIG. 7.

FIGS. 7 and 8 show the relay drive circuit 1, relay 4, and the electric connection box 20. More specifically, FIG. 7 is a schematic top view of the box 20 and FIG. 8 is a cross sectional view of the box 20 taken along the line VIII-VIII in FIG. 7.

As shown in the drawings, a case 21 of the box 20 includes an upper cover 21*a*, a lower cover 21*b*, and an inner cover 21*c*. The upper cover 21*a* and the lower cover 21*b* constitute an outer shape of the case 21 and respectively have practically U-shaped cross sections each with an open mouth. The upper cover 21*a* and the lower cover 21*b* are made so that an outer edge of the lower cover 21*b* at its open rim fits in an outer edge of the upper cover 21*a* at its open mouth. By arranging the upper cover 21*a* and the lower cover 21*b* so that the open mouths of them faces each other, and by fixing the upper cover 21*a* and the lower cover 21*b* so that the outer edge of the lower cover 21*b* at its open rim fits in the outer edge of the upper cover 21*a* at its open mouth. The upper cover 21*a* and the lower cover 21*b* form the outer shape of the case 21 as a single body.

An external connector portion 22 is located on a surface of the lower cover 21*b* opposite to another surface of the lower cover 21*b* facing the upper cover 21*a*. A plurality of connector terminals 23 are installed to the external connector portion.

The inner cover 21*c* is located at the inner side of the upper cover 21*a* and the lower cover 21*b*. The inner cover 21*c* is slightly smaller than the lower cover 21*b* and having a U-shaped cross section with an open mouth. By putting the inner cover 21*c* in the lower cover 21*b* and by rigidly fixing the inner cover 21*c* to the lower cover 21*b* with bolts, the inner cover 21*c* is fixed to the lower cover 21*b*.

In the inner cover 21*c*, a busbar substrate layer 26 is located between insulators 25*a* and 25*b*. In the inner cover 21*c*, a printed board layer 27 is also located in parallel with the busbar substrate layer 26. The busbar substrate layer 26 and the printed board layer 27 serve as a whole as an example of a wiring member.

A plurality of busbar terminals 26*a* extends from the busbar substrate layer 26, penetrating the insulator 25*a*. Each of the busbar terminals 26*a* is connected with each one of intermediating terminals 28. The inner cover 21*c* has a plurality of through holes each corresponding to each of the intermediating terminals 28. Each of terminals 29*a* of a plurality of plug-in relays 29 is connected through each of a part of the through holes with each of a part of the intermediating terminals 28. Each of terminals 30*a* of a plurality of twin relays 30 is connected through each of another part of the through holes with each of another part of the intermediating terminals 28. Each of the twin relays 30 includes two relays. Fuses 30*b* for use below 30 ampere or fusible links 30*c* for use above 30 ampere may be located on the upper surfaces of the twin relays 30 according to usage of the twin relays 30. They are used to protect the twin relays 30.

A plurality of relays 31 for the printed board 27 are located on the printed board layer 27. An IC chip 32 is also located on the printed board layer 27.

The IC chip 32 includes the relay drive circuit 1 according to the first or the second embodiment. Each of the relays 29, the twin relays 30, and the relays 31 can be to the relay 4 described in the first embodiment or the second embodiment.

Thus, it is possible to install the relay drive circuit 1 and relay 4 into the same electric connection box 20. In the case that the relay drive circuit 1 and the relay 4 are incorporated in the same box 20, it is easier to arrange wiring than in the case that the relay drive circuit 1 and the relay 4 are incorporated in separate boxes. Besides, in the case that the relay drive circuit 1 and the relay 4 are incorporated in the same box 20, it is not necessary to use wire harnesses.

Fourth Embodiment

Hereinafter, a fourth embodiment of the present invention will be described. In the present embodiment, a relay drive circuit 1 having a structure very similar to the relay drive circuit 1 of the first embodiment is connected with the high-side of the relay 4. Therefore, the relay 4 is driven from the high-side in the present embodiment. Only the difference between the present embodiment and the first embodiment is described below.

Figure 9:
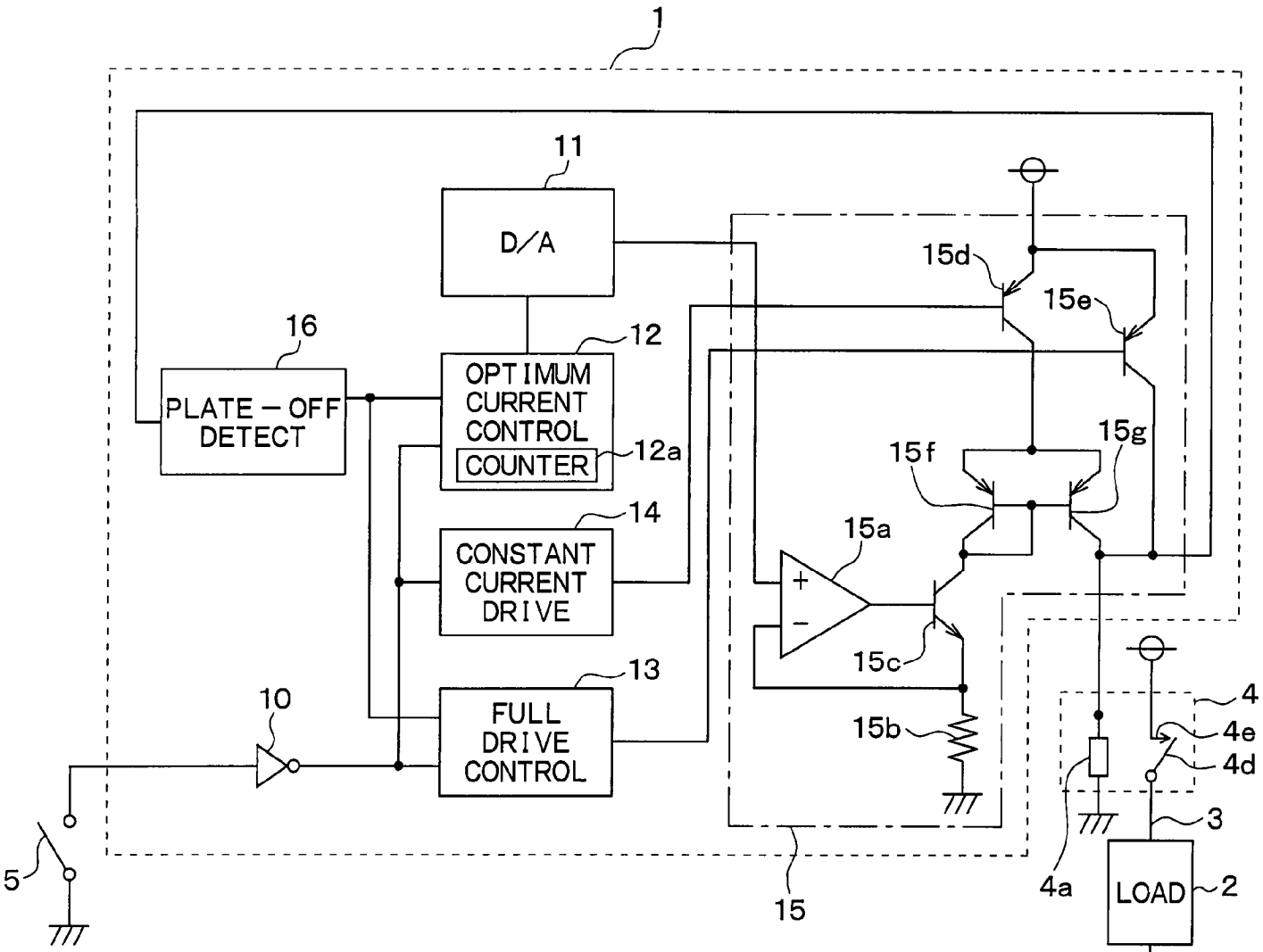
FIG. 9 is a schematic circuit diagram showing a relay drive circuit according to a fourth embodiment of the present invention.

As shown in FIG. 9, which is a schematic diagram of the relay drive circuit 1 according to the present embodiment, the current switching circuit portion 15 includes a fourth transistor 15*f* and a fifth transistor 15*g* as well as the operational amplifier 15*a*, the resistor 15*b*, and the first to third transistors 15*c* to 15*e*. The fourth transistor 15*f* and the fifth transistor 15*g* constitute a current mirror circuit. The operation of the relay drive circuit 1 is basically the same with that of the relay drive circuit 1 of the first embodiment. More specifically, the operational amplifier 15*a* outputs from its output terminal the base current for the first transistor 15*c* when the non-inverting input terminal of the operational amplifier 15*a* receives the reference voltage outputted by the D/A converter 11 and the inverting input terminal of the operational amplifier 15*a* receives the emitter potential of the first transistor 15*c*. The first transistor 15*c* accordingly outputs the collector current based on the base current for the first transistor 15*c*. Then, a current is accordingly goes through the fourth transistor 15*f*, and a current based on a current mirror ratio of the current mirror circuit therefore goes through the fifth transistor 15*g*. The current at the fifth transistor 15*g* changes according to the counter value of the counter 12*a* of the optimum current control portion 12. Therefore, a current from the third transistor 15*e* driven by the full drive control portion 13 and the current from the fifth transistor 15*g* are supplied to the coil 4*a*, and the relay 4 is accordingly driven.

In the relay drive circuit 1 having the structure described above, the plate-OFF detecting portion 16 can detect the OFF-tendency based on the potential of the high-side of the coil 4*a*. The plate-OFF detecting portion 16 has a structure shown in FIG. 10.

Figure 10:
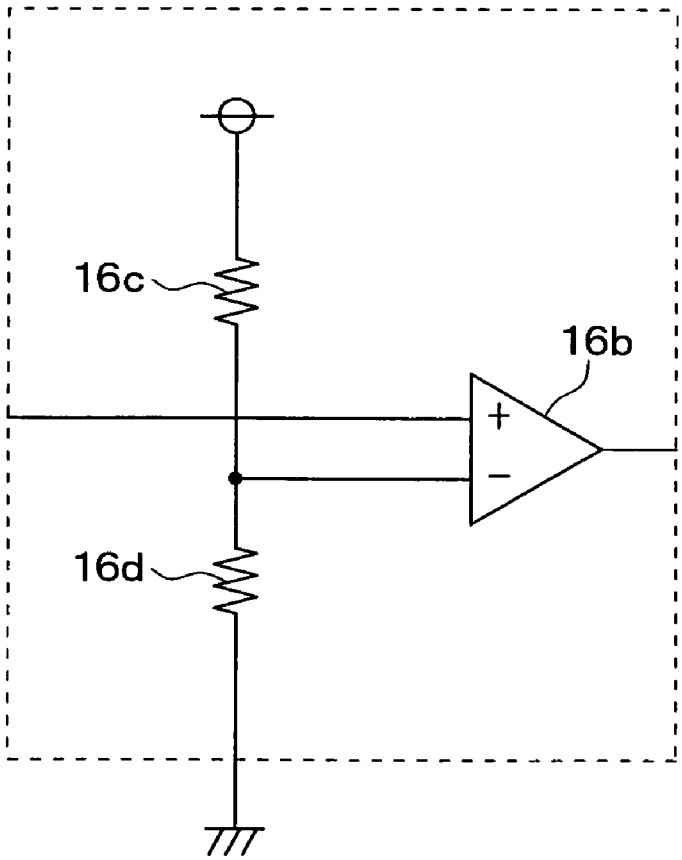
FIG. 10 is a schematic diagram showing a circuit structure of a plate-OFF sensing portion of the relay drive circuit shown in FIG. 9.

As shown in FIG. 10, the plate-OFF detecting portion 16 of the present embodiment includes the comparator 16*b*, resistor 16*c*, and the resistor 16*d*. However, the plate-OFF detecting portion 16 does not have the capacitor 16*a* which is included by the relay drive circuit 1 of the first embodiment.

With this structure, the potential at the high-side of the coil 4*a* is detected as a difference of the high-side potential from the ground. Therefore, it is easy to measure a potential corresponding to the voltage between both ends of the coil 4*a*. In the case that the relay drive circuit 1 is located at the low-side of the relay 4, a battery voltage is directly applied to the coil 4*a*, and the potential at the low-side of the coil 4*a* sensitively changes according to the change of the battery voltage. Therefore the capacitor 16*a* which serves as a highpass filter is required in this case. In contrast, with the structure of the present embodiment, the capacitor 16*a* as a highpass filter can be disused since the potential at the high-side of the coil 4*a* does not sensitively change according to the change of the battery potential (power source).

Fifth Embodiment

Hereafter, the fifth embodiment of the present invention will be described. A relay drive circuit 1 according to the present embodiment is based on the relay drive circuit 1 of the fourth embodiment which drives the relay 4 from the high-side of the relay 4 but differs in the structures of the D/A converter 11 and the current switching circuit portion 15. Only the difference between the relay drive circuit 1 of the present embodiment and the relay drive circuit 1 of the fourth embodiment will be described below.

Figure 11:
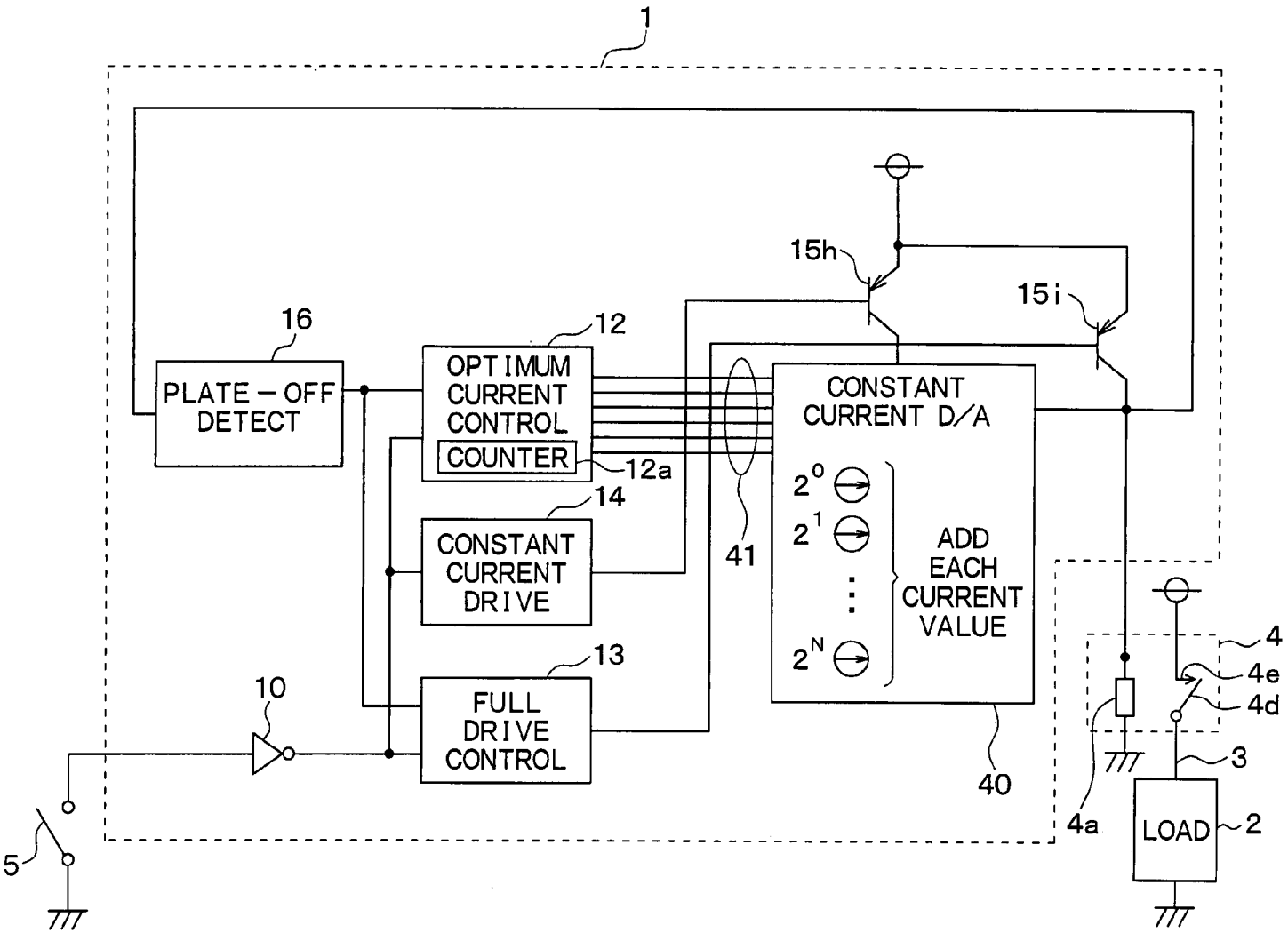
FIG. 11 is a schematic circuit diagram showing a relay drive circuit according to a fifth embodiment of the present invention.

FIG. 11 is a schematic circuit diagram showing the relay drive circuit 1 according to the present embodiment. As shown in the drawing, the relay drive circuit 1 includes, in place of the D/A converter 11 in the fourth embodiment, a constant current D/A converter (or a weighting circuit) 40. The constant current D/A converter 40 is connected with the optimum current control portion 12 through data lines 41 for transmitting a plurality of bits at the same time. The optimum current control portion 12 outputs through the data lines 41 a data value consisting of the multiple bits, the data value corresponding to a current value at which the constant current D/A converter 40 should output a current. The constant current D/A converter 40 includes a plurality of constant current circuits each weighted by $2^n$wherein the integer n varies from 0 to N. The constant current D/A converter 40 receives the collector current of a transistor 15*h* serving as a constant current source and turns each of the constant current circuits to ON or OFF to generate a constant current corresponding to the data value. The generated constant current is added to the collector current of a transistor 15*i* driven by the full drive control portion 13 and is supplied to the coil 4*a* along with the collector current.

The optimum current control portion 12 of the present embodiment sets a current value outputted by the constant current D/A converter 40 so that the coil current Ir supplied to the coil 4*a* becomes optimal. The optimum current control portion 12 then outputs the data value corresponding to the set current value. For example, the optimum current control portion 12 may include the counter 12*a* and output the data value indicating a counter value stored by the counter 12*a* to the constant current D/A converter 40 through the data lines 41. Since the data value indicating the counter value corresponds to the current value to be outputted by the constant current D/A converter 40, the constant current D/A converter 40 outputs, on receiving the outputted data value, the current having the current value corresponding to the counter value indicated by the received data value.

As described above, the constant current D/A converter 40 may be constructed by the D/A converter 11 described in the first embodiment and the like and a part of the current switching circuit portion 15. In the relay drive circuit 1 having the constant current D/A converter 40 described above, when the optimum current control portion 12 outputs the data value corresponding to the counter value, the data value is directly translated by the constant current D/A converter 40. In the first embodiment or the like where the D/A converter 11 and the current switching circuit portion 15 are used, the signal outputted by the optimum current control portion 12 is transformed by the D/A converter 11 in a logical manner into the voltage signal for the operational amplifier 15*a* and in turn the voltage signal is transformed into the current signal by the operational amplifier 5*a* and the first transistor 15*c*. In the present embodiment, this complicated transformation is not necessary. Therefore it is possible to simplify the circuit configuration of the relay drive circuit 1.

In the present embodiment, the constant current D/A converter 40 and the transistors 15*h* and 15*i* serve not only as the current switching circuit portion 15 in the first embodiment or the like but also as the D/A converter 11. Therefore the constant current D/A converter 40 and the transistors 15*h* and 15*i* serve as a whole as the current switching portion, and the optimum current control portion 12 serves as the optimum current setting portion.

Other Embodiments

The present invention should not be limited to the embodiment discussed above and shown in the figures, but may be implemented in various ways without departing from the spirit of the invention.

For example, in the first to third embodiments, the plate-OFF detecting portion 16 may detect, as the potential to be sensed, the difference of the potentials between both ends of the coil 4*a* in place of the potential at the low-side of the coil 4*a*. In the case of using the potential at the low-side of the coil 4*a* as the potential to be sensed, it is possible to detect the change of the Ir required value according to the change of the inductance of the coil 4*a* by monitoring just a single potential at a single point.

In the first to fourth embodiments, each of the D/A converter 11 and the optimum current control portion 12 is constructed as a single microcomputer, and the reference potential outputted by the D/A converter 11 is determined based on the counter value of the optimum current control portion 12. However, this is just an example. The D/A converter 11 and the optimum current control portion 12 may be replaced with any device such as a logic circuit if it can store the counter value indicating the reference potential outputted by the D/A converter 11.

In the fourth and fifth embodiments, the relay drive circuit 1 and the relay 4 can be commonly installed in the electric connection box 20 described in the third embodiment.

In the fifth embodiment, the relay 4 may be located at the low-side of the relay drive circuit 1, and the relay drive circuit 1 may drive the relay drive circuit 1 through the low-side of the relay 4.

What is claimed is:

1. A relay drive circuit for controlling, based on ON/OFF operation of a relay switch, power supply to a coil of an electromagnetic relay in order to control power supply to a load, the relay including: the coil; a core inserted in the coil; a plate including magnetic material, the plate magnetically drawn to come in contact with a head of the core when the coil is supplied with electric power, the plate getting apart from the bead when the coil is not supplied with electric power; a movable contact moving along with the plate; and a fixed contact installed to the coil, the relay drive circuit comprising:

a first drive portion for setting a coil current to be supplied to the coil to a first current value with which the plate is drawn to the head of the coil and the movable contact comes in contact with the fixed contact;

a second drive portion for setting the coil current to a second current value which is smaller than the first current value set by the first drive portion, so that the movable contact and the fixed contact are kept in contact with each other;

a current switching portion for switching between supplying the coil with the coil current having the first current value set by the first drive portion and supplying the coil with the coil current having the second current value set by the second drive portion; and a plate-OFF detecting portion for detecting, based on change of a potential at an end of the coil, an OFF-tendency in which the plate is about to get apart from the head of the coil the detecting being made before the plate gets apart from the head of the coil, wherein the current switching portion switches to supplying the coil with the coil current having the first current value set by the first drive portion to prevent the relay from turning to OFF, when the plate-OFF detecting portion detects the OFF-tendency.

2. The relay drive circuit according to claim 1 wherein, the current switching portion is Located at a low-side of the relay and drives the relay through the low-side, and the plate-OFF detecting portion detects the OFF-tendency based on change of a potential at the low-side of the coil.

3. The relay drive circuit according to claim 2 wherein, the plate-OFF detecting portion includes a highpass filter for passing only high frequency components in the potential at the low-side of the coil, and the plate-OFF detecting portion detects the OFF-tendency when change of the high frequency components is larger than a threshold.

4. The relay drive circuit according to claim 1 wherein, the current switching portion is located at a high-side of the relay and drives the relay through the high-side, and the plate-OFF detecting portion detects the OFF-tendency based on change of a potential at the high-side of the coil.

5. The relay drive circuit according to claim 1, further comprising:

an optimum current setting portion for controlling the current switching portion so that the second current value becomes optimal, wherein the optimum current setting portion sets, when the plate-OFF detecting portion detects the OFF-tendency while the coil current with the second current value is being supplied to the coil, a new value as the second current value which is larger than an old value set as the second current value before detection the OFF-tendency.

6. The relay drive circuit according to claim 5, wherein, the current switching portion switches, when the relay switch is turned to ON, to supplying the coil with the coil current having the first current value so as to draw the plate so that the movable contact comes in contact with the fixed contact, the current switching portion subsequently switches to supplying the coil with the coil current having the second current value, the optimum current setting portion subsequently decreases the second current value gradually from an initial current value, and the optimum current setting portion sets, on detecting the OFF-tendency in decreasing the second current value, the new value as the second current value which is larger than an old value which, was the second current value at the time of the detection the OFF-tendency.

7. The relay drive circuit according to claim 5, wherein, the current switching portion switches, when, the plate-OFF detecting portion detects the OFF-tendency, to supplying the coil with the coil current having the first current value so as to draw the plate so that the movable contact comes in contact with the fixed contact, the current switching portion subsequently switches to supplying the coil with the coil current having the second current value, the optimum current setting portion subsequently decreases the second current value gradually from an initial current value, and the optimum current setting portion sets, on detecting the OFF-tendency in decreasing the second current value, the new value as the second current value which is larger than the old value set as the second current value before the detection the OFF-tendency.

8. The relay drive circuit according to claim 5, wherein, the optimum current setting portion includes:

a D/A converter for generating a potential corresponding to a counter value; and an optimum current control portion for counting the counter value, and the relay drive circuit changes the potential outputted by the D/A convener by changing the counter value of the optimum current control portion so as to decrease the current value of the coil current gradually from the first current value.

9. The relay drive circuit according to claim 5, wherein, the optimum current setting portion includes en optimum current control portion including a counter for counting a counter value, the current switching portion includes a constant current D/A converter for executing weighting based on the counter value so as to change a value of a current to output from the constant current D/A converter, and the relay drive circuit changes the value of the current outputted by the constant current D/A converter by changing the counter value of the optimum current control portion so as to decrease the current value of the coil current gradually horn the first current value.

10. A relay drive circuit for controlling power supply to a coil of an electromagnetic relay, comprising:

a first drive portion for selectively supplying a first coil current to the coil, the first void current having a first current value that is sufficient to cause a plate in the electromagnetic relay to be drawn to the head of the coil, resulting in a movable contact coming in contact with fixed contact in the electromagnetic relay;

a second drive portion for selectively supplying a second coil current to the coil, the second coil current having a second current value that is smaller than the first current value, but sufficient to keep the movable contact in contact with the fixed contact;

a plate-OFF detecting portion for detecting, based on change of a potential at an end of the coil, when The plate is about to move apart from the head of the coil, the detecting being made before the plate moves apart from the head of the coil, and for providing a plate-OFF signal indicating when the plate is about to move apart from the head of the coil; and a current switching portion for switching between supplying the coil with the first coil current and the second coil current in response to the plate-OFF signal.

11. The relay drive circuit according to claim 10, wherein, the current switching portion is located at a low-side of the relay and drives the relay through the low-side, and the plate-OFF detecting portion detects the OFF-tendency based on change of a potential at the low-side of the coil.

12. The relay drive circuit according to claim 11, wherein, the plate-OFF detecting portion includes a highpass filter for passing only high frequency components m the potential at the low-side of the coil, and the plate-OFF detecting portion detects the OFF-tendency when change of the high frequency components is larger than a threshold.

13. The relay drive circuit according to claim 10, wherein, the current switching portion is located at a high-side of the relay and drives the relay through the high-side, and the plate-OFF detecting portion detects the OFF-tendency based on change of a potential at the big-side of the coil.

14. The relay drive circuit according to claim 10, further comprising:

an optimum current setting portion for controlling the current switching portion so that the second current value becomes optimal, wherein the optimum current setting portion sets, when the plate-OFF detecting portion detects the OFF-tendency while the coil current with the second current value is being supplied to the coil, a new value as the second current value which is larger than an old value set as the second current value before detection the OFF-tendency.

* * * * *